US011149743B2

(12) United States Patent
Yamamoto et al.

(10) Patent No.: US 11,149,743 B2
(45) Date of Patent: Oct. 19, 2021

(54) PROPELLER FAN AND OUTDOOR UNIT FOR AIR-CONDITIONING APPARATUS

(71) Applicant: Mitsubishi Electric Corporation, Tokyo (JP)

(72) Inventors: Katsuyuki Yamamoto, Tokyo (JP); Seiji Nakashima, Tokyo (JP); Kazunori Korenaga, Tokyo (JP)

(73) Assignee: Mitsubishi Electric Corporation, Tokyo (JP)

( * ) Notice: Subject to any disclaimer, the term of this patent is extended or adjusted under 35 U.S.C. 154(b) by 0 days.

(21) Appl. No.: 16/484,109

(22) PCT Filed: Apr. 19, 2017

(86) PCT No.: PCT/JP2017/015569
§ 371 (c)(1),
(2) Date: Aug. 6, 2019

(87) PCT Pub. No.: WO2018/193545
PCT Pub. Date: Oct. 25, 2018

(65) Prior Publication Data

US 2020/0040906 A1 Feb. 6, 2020

(51) Int. Cl.
*F04D 29/68* (2006.01)
*F04D 29/38* (2006.01)

(52) U.S. Cl.
CPC ..... *F04D 29/384* (2013.01); *F04D 29/681* (2013.01)

(58) Field of Classification Search
CPC .... F04D 29/384; F04D 29/386; F04D 29/681; F04D 29/661; F04D 29/663; F04D 29/667
See application file for complete search history.

(56) References Cited

U.S. PATENT DOCUMENTS 9,394,911 B2 * 7/2016 Nakashima ..... F04D 19/002
2011/0286850 A1 11/2011 Micheli et al.
(Continued)

FOREIGN PATENT DOCUMENTS

CN 1865709 A 11/2006
JP 2001-099093 A 4/2001
(Continued)

OTHER PUBLICATIONS

JP-2011099409 Google Patent Translation Nov. 5, 2020.*
(Continued)

*Primary Examiner* — Woody A Lee, Jr.
*Assistant Examiner* — Sabbir Hasan
(74) *Attorney, Agent, or Firm* — Posz Law Group, PLC

(57) ABSTRACT

A propeller fan includes a shaft part and a blade. The blade includes a basal part connected to the shaft part, a first part positioned either at the basal part or closer to an outer circumference of the propeller fan than is the basal part and away from the rotation axis by a distance r1, a second part positioned away from the rotation axis by a distance r2 that is longer than r1, a third part positioned away from the rotation axis by a distance r3 that is longer than or equal to r2, and a tip part positioned at an outer circumferential end of the blade and away from the rotation axis by a distance rt that is longer than r3. A relationship expressed as $(\theta 2-\theta 1)/(r2-r1)>(\theta t-\theta 3)/(rt-r3)\geq 0$ is satisfied.

7 Claims, 6 Drawing Sheets

(56) References Cited

U.S. PATENT DOCUMENTS

| | | | |
|---|---|---|---|
| 2015/0071786 | A1 | 3/2015 | Kumon et al. |
| 2018/0038384 | A1 | 2/2018 | Kumon et al. |

FOREIGN PATENT DOCUMENTS

| | | | | |
|---|---|---|---|---|
| JP | 2003-013891 | A | | 1/2003 |
| JP | 2003-156000 | A | | 5/2003 |
| JP | 3761137 | B2 | | 3/2006 |
| JP | 2011-099409 | A | | 5/2011 |
| JP | 2011099409 | A | * | 5/2011 |
| JP | 4937331 | B2 | | 5/2012 |
| JP | 2013-119816 | A | | 6/2013 |
| JP | 2013-217313 | A | | 10/2013 |

OTHER PUBLICATIONS

Office Action dated Jun. 3, 2020 issued in corresponding CN patent application No. 201780089547.5 (and English translation).
Examination Report dated Jun. 17, 2020 issued in corresponding in patent application No. 201947039085.
Office Action dated Jul. 21, 2020 issued in corresponding JP patent application No. 2019-513136 (and English translation).
International Search Report of the International Searching Authority dated Jul. 4, 2017 for the corresponding International application No. PCT/JP2017/015699 (and English translation).

* cited by examiner

PROPELLER FAN AND OUTDOOR UNIT FOR AIR-CONDITIONING APPARATUS

CROSS REFERENCE TO RELATED APPLICATION

This application is a U.S. national stage application of PCT/JP2017/015699 filed on Apr. 19, 2017, the contents of which are incorporated herein by reference.

TECHNICAL FIELD

The present invention relates to a propeller fan and an outdoor unit for an air-conditioning apparatus, the outdoor unit including the same.

BACKGROUND ART

Patent Literature 1 describes a jet fan including moving blades. Each of the moving blades has such a blade shape in which one of the surfaces is warped. Further, each of the moving blades has a warping angle distribution in which the warping angle gradually decreases from the tip end toward the base of the moving blade.

CITATION LIST

Patent Literature

Patent Literature 1: Japanese Unexamined Patent Application Publication No. 2003-156000

SUMMARY OF INVENTION

Technical Problem

In each of the moving blades described in Patent Literature 1, as the warping angle gradually increases from the base toward the tip end of the moving blade, it is not possible to sufficiently suppress a radial-direction flow, which is an air flow on the suction surface of the moving blade flowing in the radial direction due to a centrifugal force. The radial-direction flow on the suction surface collides with a blade tip vortex formed on the suction surface at a tip end part of the blade. As a result, as the formation of the blade tip vortex becomes unstable, a problem arises where noise is increased.

To solve the problem described above, it is an object of the present invention to provide a propeller fan and an outdoor unit for an air-conditioning apparatus that are capable of reducing the noise.

Solution to Problem

A propeller fan according to an embodiment of the present invention includes a shaft part provided along a rotation axis, and a blade provided outside an outer circumference of the shaft part. The blade includes a basal part connected to the shaft part, a first part positioned either at the basal part or closer to an outer circumference of the propeller fan than is the basal part and away from the rotation axis by a distance r1, a second part positioned away from the rotation axis by a distance r2 that is longer than r1, a third part positioned away from the rotation axis by a distance r3 that is longer than or equal to r2, and a tip part positioned at an outer circumferential end of the blade and away from the rotation axis by a distance rt that is longer than r3. A relationship expressed as $(\theta 2-\theta 1)/(r2-r1)>(\theta t-\theta 3)/(rt-r3)\geq 0$ is satisfied, where θ1 denotes a warping angle of the blade in the first part, θ2 denotes a warping angle of the blade in the second part, θ3 denotes a warping angle of the blade in the third part, and θt denotes a warping angle of the blade in the tip part.

An outdoor unit for an air-conditioning apparatus according to another embodiment of the present invention includes the propeller fan according to the embodiment of the present invention.

Advantageous Effects of Invention

According to an embodiment of the present invention, it is possible to suppress the radial-direction flow formed on the suction surface of the blade. It is therefore possible to prevent the radial-direction flow from colliding with a blade tip vortex and to stabilize the formation of the blade tip vortex. Further, according to an embodiment of the present invention, it is possible to suppress a leak flow flowing from the pressure surface toward the suction surface of the blade. It is therefore possible to further stabilize the formation of the blade tip vortex. Consequently, according to an embodiment of the present invention, it is possible to reduce the noise of the propeller fan.

DESCRIPTION OF EMBODIMENTS

Embodiment 1

Figure 1:
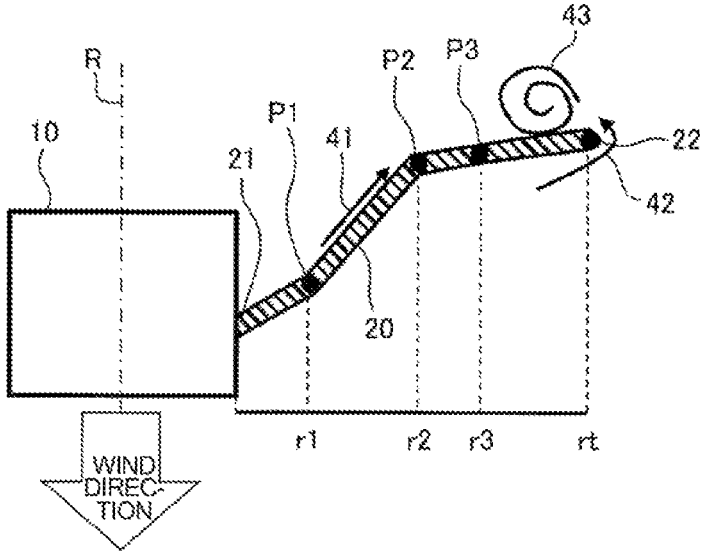
FIG. 1 is a cross-sectional view illustrating a schematic configuration of a propeller fan according to Embodiment 1 of the present invention.

A propeller fan according to Embodiment 1 of the present invention will be explained. The propeller fan is, for example, used for an air-conditioning apparatus, a ventilation device, or other devices. FIG. 1 is a cross-sectional view illustrating a schematic configuration of the propeller fan according to the present embodiment. FIG. 1 shows a radial-direction cross-section of the propeller fan taken along a plane including a rotation axis R. In the drawings referenced below including FIG. 1, the relationships of relative dimensions among the components as well as the shapes and other elements of the components may be different from those in actuality.

As shown in FIG. 1, the propeller fan includes a boss 10 (an example of the shaft part) provided along the rotation axis R and configured to rotate about the rotation axis R, a plurality of plate-like blades 20 (FIG. 1 shows only one of the blades 20) provided outside the outer circumference of the boss 10, and a motor (not shown) configured to drive and cause the boss 10 and the plurality of blades 20 to rotate. The direction of the wind generated by the rotation of the blades 20 is toward the bottom of the drawing page of FIG. 1. Further, in FIG. 1, the top surface of the blade 20 is a suction surface, whereas the bottom surface of the blade 20 is a pressure surface.

The blade 20 has a basal part 21 connected to the boss 10, and a tip part 22 positioned at the outer circumferential end of the blade 20. The distance from the rotation axis R to the tip part 22 is expressed as rt. In a circumferential-direction cross-section shown in FIG. 3 (explained later), the blade 20 is warped to be convex on the suction surface and to be concave on the pressure surface. Further, the blade 20 has a predetermined warping angle distribution in the radial direction. In other words, the warping angle of the blade 20 varies with the distance from the rotation axis R. The definition of the warping angle will be explained later with reference to FIG. 3.

The blade 20 has, in the section (including the basal part 21 itself) between the basal part 21 and the tip part 22, a first part P1, a second part P2, and a third part P3. The first part P1 is an arbitrary part positioned either closer to the outer circumference of the propeller fan than is the basal part 21 or at the basal part 21. The distance from the rotation axis R to the first part P1 is r1. The second part P2 is positioned closer to the outer circumference than is the first part P1. The distance from the rotation axis R to the second part P2 is r2 that is longer than the distance r1 ($r1<r2$). The third part P3 either coincides with the second part P2 or is positioned closer to the outer circumference than is the second part P2. Further, the third part P3 is positioned closer to the inner circumference of the propeller fan than is the tip part 22. The distance from the rotation axis R to the third part P3 is r3 that is longer than or equal to the distance r2 and is shorter than the distance rt ($r2\leq r3<rt$). The distance r1, the distance r2, the distance r3, and the distance rt satisfy the relationship expressed as $r1<r2\leq r3<rt$. Further, it is desirable that the distance r1 and the distance rt satisfy the relationship expressed as $0.5rt\leq r1$.

Figure 2:
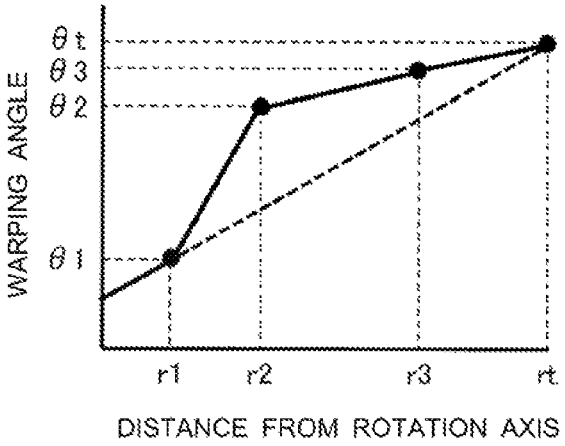
FIG. 2 is a graph showing a relationship between distances from a rotation axis R and warping angles of a blade 20 of the propeller fan according to Embodiment 1 of the present invention.

FIG. 2 is a graph showing a relationship between distances from the rotation axis R and warping angles of the blade 20 of the propeller fan according to the present embodiment, i.e., a distribution of the warping angles in the radial direction of the blade 20. The horizontal axis in FIG. 2 expresses the distances from the rotation axis R, whereas the vertical axis expresses the warping angles. FIG. 2 illustrates the warping angle distribution of the blade 20 according to the present embodiment with a solid line and illustrates a warping angle distribution of a blade of a comparative example with a broken line. In the warping angle distribution of the blade of the comparative example, the warping angle linearly increases as the distance from the rotation axis R increases.

In the blade 20 according to the present embodiment, the warping angle in the part (i.e., the first part P1) that is away from the rotation axis by the distance r1 is expressed as θ1. The warping angle in the part (i.e., the second part P2) that is away from the rotation axis by the distance r2 is expressed as θ2. The warping angle in the part (i.e., the third part P3) that is away from the rotation axis by the distance r3 is expressed as θ3. The warping angle in the part (i.e., the tip part 22) that is away from the rotation axis by the distance rt is expressed as θt. As shown in FIG. 2, the blade 20 is formed to satisfy the relationship presented below.

$$(\theta 2-\theta 1)/(r2-r1)>(\theta t-\theta 3)/(rt-r3)\geq 0$$

As a result of the warping angle distribution described above, in the present example, at least a section of the blade 20 from the first part P1 to the tip part 22 is curved to be convex on the suction surface and to be concave on the pressure surface, in the radial-direction cross-section shown in FIG. 1.

In this situation, in the example illustrated in FIG. 1 and FIG. 2, in each of the section from the first part P1 to the second part P2, the section from the second part P2 to the third part P3, and the section from the third part P3 to the tip part 22 of the blade 20, the warping angle increases monotonously and linearly as the distance from the rotation axis R increases. However, possible distributions of the warping angle in each of the sections are not limited to the distribution shown in the example in FIG. 1 and FIG. 2. For example, the warping angle in the section from the first part P1 to the second part P2 does not necessarily have to increase linearly and does not necessarily have to increase monotonously. Further, the warping angle in the section from the second part P2 to the third part P3 does not necessarily have to increase and may decrease as the distance from the rotation axis R increases. Further, the warping angle in the section from the third part P3 to the tip part 22 does not necessarily have to increase and may be constant regardless of the distance from the rotation axis R.

Figure 3:
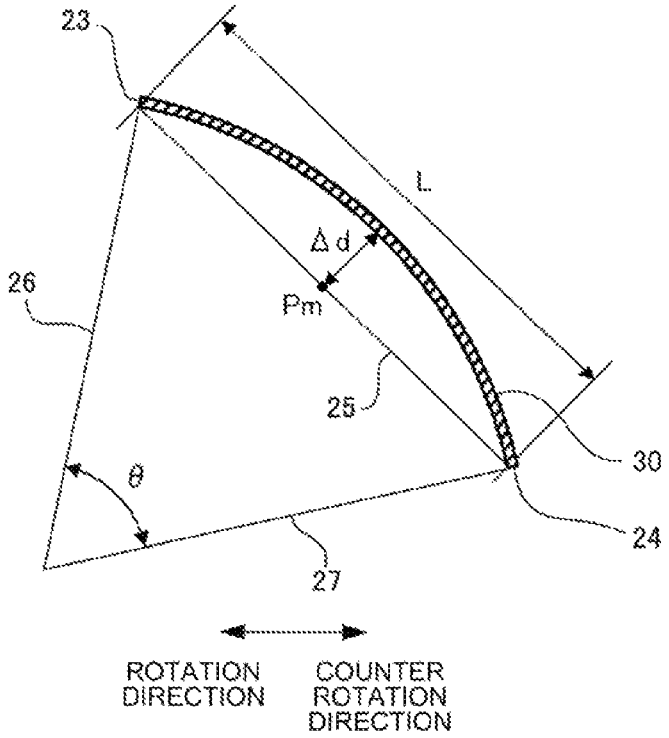
FIG. 3 is a drawing for explaining a definition of the warping angle of the blade 20 of the propeller fan according to Embodiment 1 of the present invention.

FIG. 3 is a drawing for explaining a definition of the warping angle of the blade 20 of the propeller fan according to the present embodiment. FIG. 3 shows a blade cross-section 30 obtained by developing, into a two-dimensional plane, a three-dimensional blade cross-sectional plane at which the blade 20 is cut off at the surface of a circular cylinder centered on the rotation axis R. The left direction on the page of FIG. 3 is the rotation direction, whereas the right direction is the counter rotation direction. In the blade cross-section 30, the straight line connecting the end point at the leading edge 23 to the end point at the trailing edge 24 will be referred to as a chord 25, while the length of the chord 25 will be referred to as a chord length L. A point Pm is the middle point of the chord 25. The blade cross-section 30 is warped to be convex on the suction surface and to be concave on the pressure surface. For this reason, the blade cross-section 30 is shifted from the chord 25 in the counter rotation direction. The maximum distance between the blade cross-section 30 and the chord 25 in a direction perpendicular to the chord 25 is expressed as Δd, which denotes the blade height.

When the blade cross-section 30 developed into the two-dimensional plane is arc-shaped, the warping angle can be expressed as θ, which is an angle formed by a perpendicular line 26 to the tangent line of the arc at the end point at the leading edge 23 and a perpendicular line 27 to the tangent line of the arc at the end point at the trailing edge 24. In contrast, when the blade cross-section 30 developed into the two-dimensional plane is not arc-shaped, the warping angle can be expressed as θ, which satisfies the relationship expressed as $\Delta d\cdot(2/L)=(1/\sin(\theta/2))-(1/\tan(\theta/2))$, and is larger than 0° and smaller than 90° (0°<θ<90°). The warping angle θ is an angle representing the degree of warping of the blade cross-section 30. When the chord length L is constant, the larger the warping angle θ is, the higher the blade height Δd is. In FIG. 1, the changes in the blade height Δd that varies with the distance from the rotation axis R is expressed as the shape of the blade 20.

In the blade of the comparative example having the linear warping angle distribution as represented with the broken line in FIG. 2, it is not possible to increase the blade height of a part close to the outer circumference to be sufficiently high from the blade height of a part close to the inner circumference. For this reason, it is not possible to sufficiently suppress a radial-direction flow 41 (see FIG. 1) of air generated on the suction surface by a centrifugal force. The radial-direction flow 41 on the suction surface would collide with a blade tip vortex 43 formed on the suction surface of the tip part of the blade. As a result, as the formation of the blade tip vortex 43 would become unstable, the noise of the propeller fan would increase.

In a blade having a linear warping angle distribution, when the slope of the warping angle is increased to be sufficiently large with respect to the distance from the rotation axis R, it might be possible to suppress the radial-direction flow 41 formed on the suction surface. However, in this situation, as the blade 20 would be too upright at the tip part 22, it would not be possible to suppress a radial-direction flow of air on the pressure surface. As a result, a leak flow 42 (see FIG. 1) flowing from the pressure surface toward the suction surface would increase. Consequently, as the formation of the blade tip vortex 43 would become unstable, the noise of the propeller fan would, again, increase.

In the blade 20 according to the present embodiment, it is possible to increase the increasing amount of the warping angle in the second part P2 from the increasing amount of the warping angle in the first part P1 to be larger than that in the blade of the comparative example. For this reason, it is possible to increase the blade height in the second part P2 to be sufficiently high from the blade height in the first part P1. Consequently, as it is possible to suppress the radial-direction flow 41 formed on the suction surface, it is possible to prevent the radial-direction flow 41 from colliding with the blade tip vortex 43. It is therefore possible to stabilize the formation of the blade tip vortex 43.

Further, in the blade 20 according to the present embodiment, it is possible to reduce the increasing amount of the warping angle in the tip part 22 from the increasing amount of the warping angle in the third part P3 to be smaller than that in the blade of the comparative example. For this reason, it is possible to suppress the leak flow 42 flowing from the pressure surface toward the suction surface. It is therefore possible to further stabilize the formation of the blade tip vortex 43. Consequently, it is possible to reduce the noise of the propeller fan and to improve efficiency of the propeller fan.

Because the workload in the vicinity of the basal part 21 of the blade 20 is small, flows in the vicinity of the basal part 21 are easily affected by flows flowing outside the outer circumference of the basal part 21. For this reason, even when the increasing amount of the warping angle is raised in the vicinity of the basal part 21, it would be difficult to achieve an advantageous effect of suppressing the radial-direction flow 41 formed on the suction surface. Consequently, it is desirable that the distance r1 from the rotation axis R to the first part P1 is longer than or equal to a half of the distance rt from the rotation axis R to the tip part 22 (0.5rt≤r1).

The blade 20 can have various shapes depending on blade shape parameters other than the warping angles. However, when the warping angle distribution in the radial direction of the blade 20 satisfies the relationship presented below, it is possible to relatively achieve the same advantageous effects as those described above, regardless of the shape of the blade.

$$(\theta 2-\theta 1)/(r2-r1)>(\theta t-\theta 3)/(rt-r3)\geq 0$$

Figure 4:
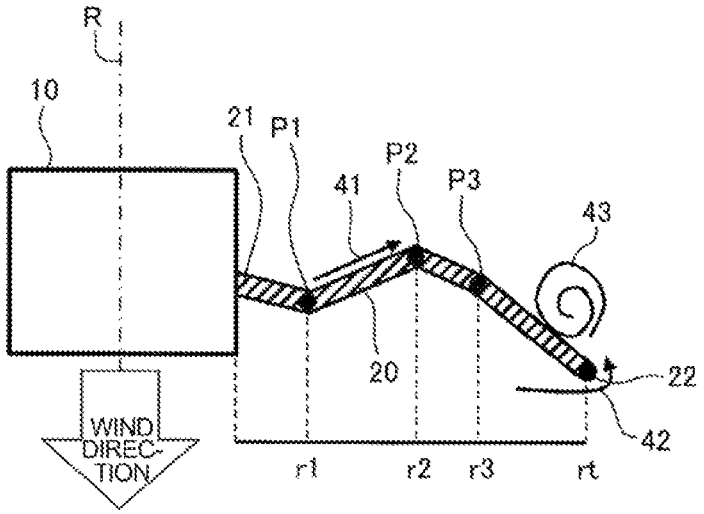
FIG. 4 is a cross-sectional view illustrating a schematic configuration of a propeller fan according to a modification example of Embodiment 1 of the present invention.

FIG. 4 is a cross-sectional view illustrating a schematic configuration of a propeller fan according to a modification example of the present embodiment. As shown in FIG. 4, the blade 20 of the propeller fan of the present modification example has a blade shape in which the tip part 22 at the outermost circumference is at the most downstream position. In a blade having such a blade shape, as the tip part 22 is typically at the most downstream position, the radial-direction flow 41 flowing from the inner circumference toward the outer circumference tends to be large on the suction surface.

However, the blade 20 of the present modification example is formed so that the distribution of the warping angles in the radial direction satisfies the relationship expressed as (θ2−θ1)/(r2−r1)>(θt−θ3)/(rt−r3)≥0. For this reason, it is possible to increase the increasing amount of the warping angle in the second part P2 from the increasing amount of the warping angle in the first part P1 to be larger than that in the blade of the comparative example. Consequently, as it is possible to ensure that the blade height in the second part P2 is sufficiently high from the blade height in the first part P1, it is possible to suppress the radial-direction flow 41 formed on the suction surface.

Further, in the blade 20 of the present modification example, it is possible to reduce the increasing amount of the warping angle in the tip part 22 from the increasing amount of the warping angle in the third part P3 to be smaller than that in the blade of the comparative example. For this reason, it is possible to suppress the leak flow 42 flowing from the pressure surface toward the suction surface. Consequently, also with the propeller fan in the present modification example, it is possible to form a configuration in which the noise is reduced while efficiency of the propeller fan is improved, similarly to when the propeller fan shown in FIG. 1 is used.

As explained above, it is possible to relatively achieve the same advantageous effects, with both the blade shape in which the tip part 22 is at the most upstream position and the blade shape in which the tip part 22 is at the most downstream position.

As explained above, the propeller fan according to the present embodiment includes the boss 10 (an example of the shaft part) provided along the rotation axis R and the blade 20 provided outside the outer circumference of the boss 10. The blade 20 includes the basal part 21 connected to the boss 10, the first part P1 positioned either at the basal part 21 or closer to an outer circumference of the propeller fan than is the basal part 21 and away from the rotation axis by the distance r1, the second part P2 positioned away from the rotation axis by the distance r2 that is longer than r1, the third part P3 positioned away from the rotation axis by the distance r3 that is longer than or equal to r2, and the tip part 22 positioned at the outer circumferential end of the blade 20 and away from the rotation axis by the distance rt that is longer than r3. The relationship expressed as $(\theta2-\theta1)/(r2-r1)>(\theta t-\theta3)/(rt-r3)\geq 0$ is satisfied, where θ1 denotes the warping angle of the blade 20 in the first part P1, θ2 denotes the warping angle of the blade 20 in the second part P2, θ3 denotes the warping angle of the blade 20 in the third part P3, and θt denotes the warping angle of the blade 20 in the tip part 22.

With this configuration, it is possible to suppress the radial-direction flow 41 formed on the suction surface and also possible to suppress the leak flow 42 flowing from the pressure surface toward the suction surface. Consequently, it possible to form a propeller fan of which the noise is reduced while efficiency of the propeller fan is improved.

Further, in the propeller fan according to the present embodiment, the warping angle of the blade 20 between the first part P1 and the second part P2 increases as the distance from the rotation axis R increases. The warping angle of the blade 20 between the third part P3 and the tip part 22 either increases or remains constant, as the distance from the rotation axis R increases.

With this configuration, in the entire region between the first part P1 and the second part P2, it is possible to increase the warping angle at a part close to the outer circumference to be larger than the warping angle at a part close to the inner circumference. Consequently, it is possible to suppress the radial-direction flow 41 formed on the suction surface, with higher certainty. Further, with this configuration, in the entire region between the third part P3 and the tip part 22, it is possible to have the warping angle at a part close to the outer circumference to be larger than or equal to the warping angle at a part close to the inner circumference. Consequently, it is possible to suppress the leak flow 42 flowing from the pressure surface toward the suction surface, with higher certainty.

Further, in the propeller fan according to the present embodiment, the warping angle of the blade 20 between the third part P3 and the tip part 22 either linearly changes or remains constant, as the distance from the rotation axis R increases.

Advantageous effects achieved with this configuration will be explained. In the graph shown in FIG. 2, when a part of the graph that corresponds to the warping angle between the third part P3 (at the distance r3) and the tip part 22 (at the distance rt) is upwardly convex in a warping-angle axis, as the pressure would excessively increase at the outer circumference of the blade 20, the leak flow 42 flowing from the pressure surface toward the suction surface would increase. On the contrary, when a part of the graph that corresponds to the warping angle between the third part P3 and the tip part 22 is downwardly convex in the warping-angle axis, as the warping angle would increase with a steep slope at the outer circumferential end of the blade 20, the leak flow 42 flowing from the pressure surface toward the suction surface would increase. In the present embodiment, as the warping angle between the third part P3 and the tip part 22 either linearly changes or remains constant, it is possible to prevent the pressure from excessively increasing at the outer circumference of the blade 20 and to prevent the warping angle from increasing with a steep slope at the outer circumferential end of the blade 20. Consequently, it is possible to suppress the leak flow 42 flowing from the pressure surface toward the suction surface, with higher certainty.

Embodiment 2

Figure 5:
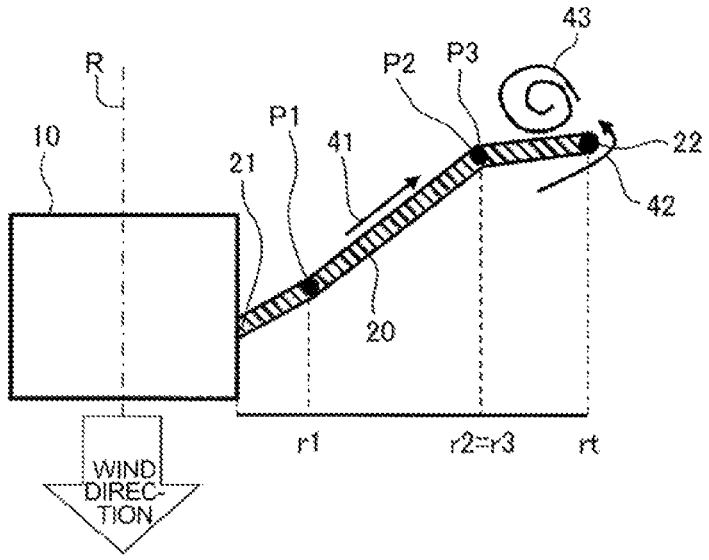
FIG. 5 is a cross-sectional view illustrating a schematic configuration of a propeller fan according to Embodiment 2 of the present invention.
Figure 6:
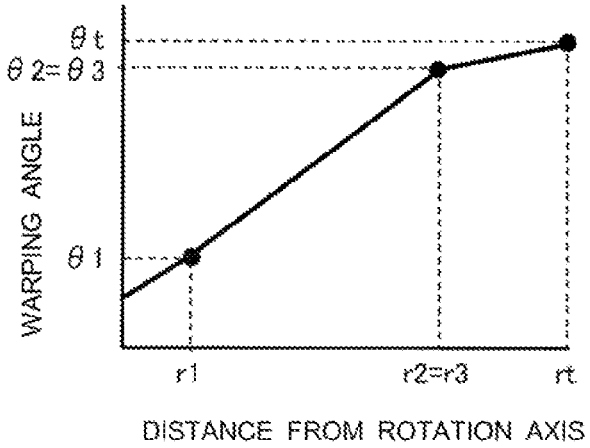
FIG. 6 is a graph showing a relationship between distances from the rotation axis R and warping angles of the blade 20 of the propeller fan according to Embodiment 2 of the present invention.

A propeller fan according to Embodiment 2 of the present invention will be explained. FIG. 5 is a cross-sectional view illustrating a schematic configuration of the propeller fan according to the present embodiment. FIG. 6 is a graph showing a relationship between distances from the rotation axis R and warping angles of the blade 20 of the propeller fan according to the present embodiment, i.e., a distribution of the warping angles in the radial direction of the blade 20. Some of the components having the same functions and actions as those in Embodiment 1 will be referred to by using the same reference signs, and the explanations of the components will be omitted. As shown in FIG. 5 and FIG. 6, the propeller fan according to the present embodiment is formed in such a manner that the second part P2 coincides with the third part P3. In other words, the propeller fan according to the present embodiment is formed to satisfy the relationship expressed as r2=r3 and to satisfy the relationship expressed as θ2=θ3.

With this configuration, in the entire region between the first part P1 and the tip part 22, the warping angle distribution of the blade 20 is appropriately defined. Consequently, according to the present embodiment, in the entire region between the first part P1 and the tip part 22, it is possible to achieve the advantageous effect where the radial-direction flow 41 is suppressed or the advantageous effect where the leak flow 42 is suppressed.

Embodiment 3

Figure 7:
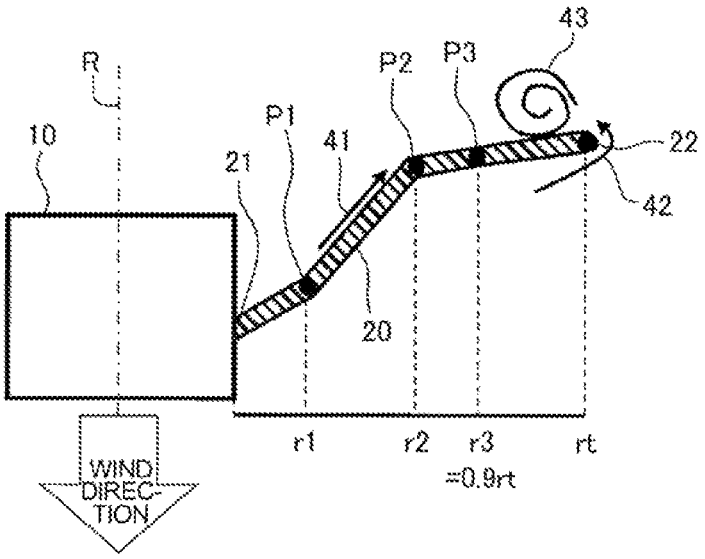
FIG. 7 is a cross-sectional view illustrating a schematic configuration of a propeller fan according to Embodiment 3 of the present invention.
Figure 8:
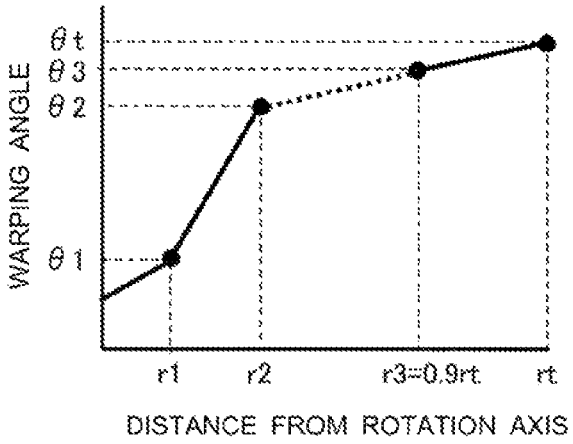
FIG. 8 is a graph showing a relationship between distances from the rotation axis R and warping angles of the blade 20 of the propeller fan according to Embodiment 3 of the present invention.

A propeller fan according to Embodiment 3 of the present invention will be explained. FIG. 7 is a cross-sectional view illustrating a schematic configuration of the propeller fan according to the present embodiment. FIG. 8 is a graph showing a relationship between distances from the rotation axis R and warping angles of the blade 20 of the propeller fan according to the present embodiment, i.e., a distribution of the warping angles in the radial direction of the blade 20. Some of the components having the same functions and actions as those in Embodiment 1 will be referred to by using the same reference signs, and the explanations of the components will be omitted. As shown in FIG. 7 and FIG. 8, the propeller fan according to the present embodiment is formed to satisfy the relationship expressed as $r2\leq r3\leq 0.9\times rt$ (e.g., $r2\leq r3=0.9\times rt$).

The width of the blade tip vortex 43 is approximately one-tenth of the distance rt from the rotation axis R to the tip part 22. For this reason, as the relationship expressed as $r3\leq 0.9\times rt$ is satisfied, the third part P3 is positioned closer to the inner circumference than is the blade tip vortex 43. Consequently, according to the present embodiment, it is possible to achieve the same advantageous effects as those in Embodiment 1, while suppressing impacts of the blade tip vortex 43.

Embodiment 4

Figure 9:
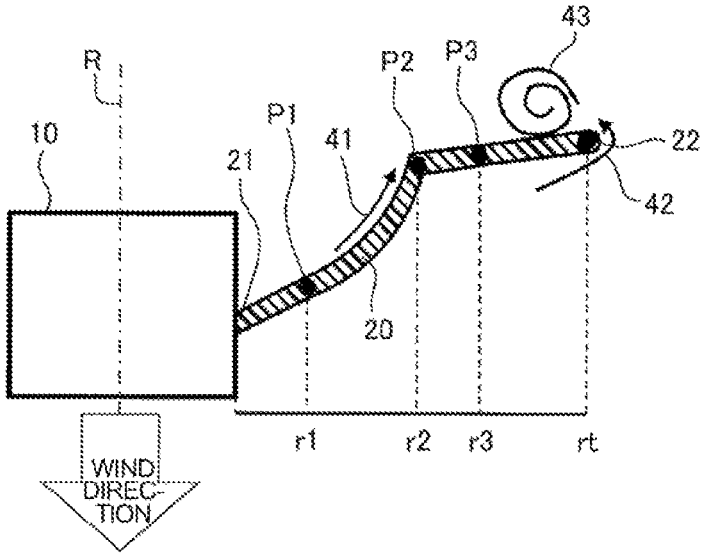
FIG. 9 is a cross-sectional view illustrating a schematic configuration of a propeller fan according to Embodiment 4 of the present invention.
Figure 10:
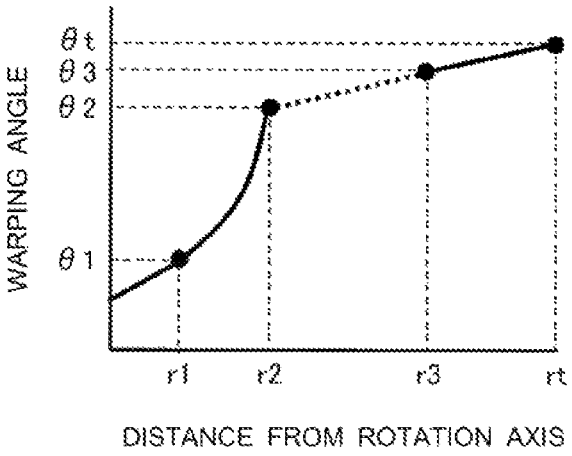
FIG. 10 is a graph showing a relationship between distances from the rotation axis R and warping angles of the blade 20 of the propeller fan according to Embodiment 4 of the present invention.

A propeller fan according to Embodiment 4 of the present invention will be explained. FIG. 9 is a cross-sectional view illustrating a schematic configuration of the propeller fan according to the present embodiment. FIG. 10 is a graph showing a relationship between distances from the rotation axis R and warping angles of the blade 20 of the propeller fan according to the present embodiment, i.e., a distribution of the warping angles in the radial direction of the blade 20. Some of the components having the same functions and actions as those in Embodiment 1 will be referred to by using the same reference signs, and the explanations the components will be omitted. As shown in FIG. 9 and FIG. 10, the propeller fan according to the present embodiment is formed in such a manner that when the relationship between the distances from the rotation axis R and the warping angles of the blade 20 is expressed in a graph, at least a part of the graph that corresponds to the section between the first part P1 and the second part P2 is downwardly convex in the warping-angle axis.

In this configuration, it is possible to provide, between the first part P1 and the second part P2, a region where the warping angle increases toward the outer circumference with a steep slope. For this reason, it is possible to suppress the radial-direction flow 41 formed on the suction surface, with higher certainty.

Figure 11:
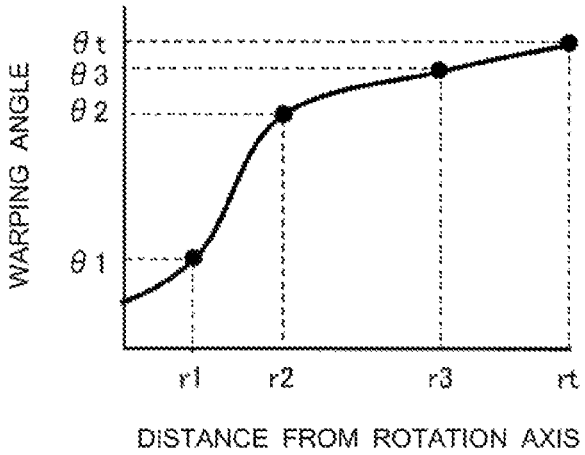
FIG. 11 is a graph showing a relationship between distances from the rotation axis R and warping angles of the blade 20 of a propeller fan according to a modification example of Embodiment 4 of the present invention.

FIG. 11 is a graph showing a relationship between distances from the rotation axis R and warping angles of the blade 20 of a propeller fan according to a modification example of the present embodiment. As shown in FIG. 11, the propeller fan according to the present modification example is formed in such a manner that at least a part of the graph that corresponds to the section between the first part P1 and the second part P2 is downwardly convex in the warping-angle axis, while the warping angle of the blade 20 smoothly changes as the distance from the rotation axis R increases. According to the present modification example, it is possible to achieve the same advantageous effects as those of the configuration shown in FIG. 9 and FIG. 10, while preventing formation of wrinkles on blade surfaces of the blade 20.

Embodiment 5

Figure 12:
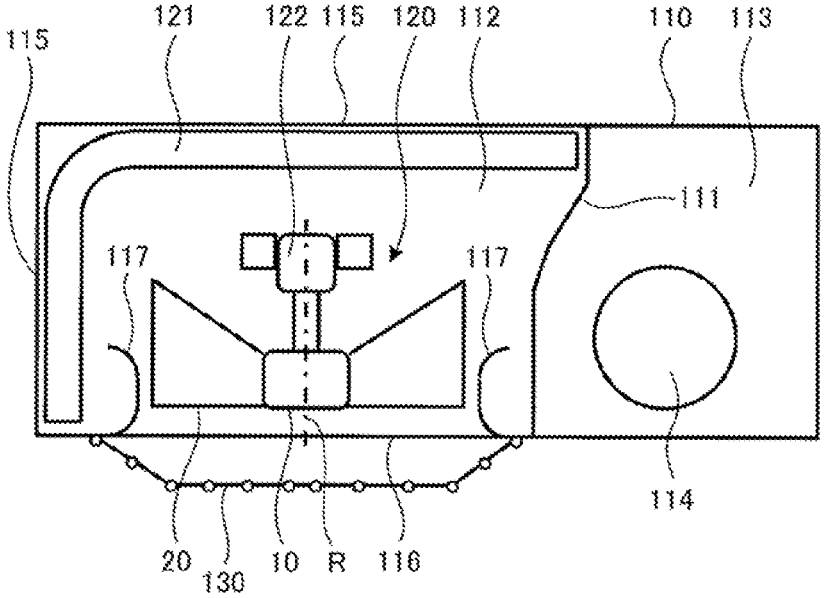
FIG. 12 is a schematic diagram illustrating a schematic configuration of an outdoor unit for an air-conditioning apparatus according to Embodiment 5 of the present invention.

An outdoor unit for an air-conditioning apparatus according to Embodiment 5 of the present invention will be explained. FIG. 12 is a schematic diagram illustrating a schematic configuration of the outdoor unit for an air-conditioning apparatus according to the present embodiment. The bottom of FIG. 12 corresponds to the front of the outdoor unit, whereas the top of FIG. 12 corresponds to the rear of the outdoor unit. As shown in FIG. 12, the outdoor unit for an air-conditioning apparatus includes a box-shaped casing 110. The casing 110 has, in the rear face and in one of the lateral faces of the casing 110, ventilation holes 115 through which air flows from the outside to the inside of the casing 110. The casing 110 has, in the front face of the casing 110, an opening port 116 through which air flows from the inside of the casing 110 to the outside, and a cylindrical bell mouth 117 guiding the air inside the casing 110 to the opening port 116. To the front face of the casing 110, a blow-out grille 130 is attached to extend over the opening port 116.

The inside of the casing 110 is partitioned by a partition plate 111 into a mechanical chamber 113 and a fan chamber 112. The mechanical chamber 113 accommodates a compressor 114, a refrigerant pipe, an electric component box, and other components. The fan chamber 112 accommodates a propeller fan 120 according to any one of Embodiments 1 to 4, and a heat exchanger 121 to which air is supplied by the propeller fan 120.

The propeller fan 120 includes the boss 10, the blades 20, and a motor 122 configured to drive and cause the boss 10 and the blades 20 to rotate about the rotation axis R. The propeller fan 120 is placed downstream of the heat exchanger 121 in a direction of the flow of the air.

The heat exchanger 121 exchanges heat between refrigerant circulating in the heat exchanger 121 and the air blown by the propeller fan 120. The heat exchanger 121 is included in a refrigeration cycle together with the compressor 114, another heat exchanger (not illustrated) provided on the load side, and other components. The heat exchanger 121, as a whole, has an L shape in cross-section. The heat exchanger 121 is placed along the rear face and the one of the lateral faces of the casing 110 in each of which the ventilation hole 115 is provided. As the heat exchanger 121, for example, a fin-and-tube heat exchanger of a cross-fin type including fins and heat transfer tubes through which the refrigerant flows is used.

When the blades 20 are driven by the motor 122, the air outside the casing 110 is sucked into the inside of the casing 110 through the ventilation holes 115. The air sucked into the inside of the casing 110 goes through the heat exchanger 121 and is blown out from the front face of the casing 110 through the opening port 116 and the blow-out grille 130.

By using the outdoor unit for an air-conditioning apparatus according to the present embodiment, it is possible to form the propeller fan 120 of which the noise is reduced while efficiency of the propeller fan 120 is improved, similarly to any of Embodiments 1 to 4.

The present invention is not limited to the embodiments described above and may be modified in various manners.

For example, in each of the embodiments described above, the propeller fan including the boss 10 is used as an example. However, the present invention is also applicable to a boss-less propeller fan including no boss. The boss-less propeller fan includes a cylinder-shaped shaft part, a plurality of blades provided outside the outer circumference of the shaft part, and a plate-like coupling part provided to be positioned adjacent to the shaft part and coupling together every pair of blades positioned adjacent to each other in the circumferential direction among the plurality of blades. In other words, the boss-less propeller fan has an integrally-formed blade in which the plurality of blades are integrally formed by use of the plate-like coupling part.

It is possible to carry out any of the embodiments and the modification examples described above in combination.

REFERENCE SIGNS LIST

10 boss 20 blade 21 basal part 22 tip part 23 leading edge 24 trailing edge 25 chord 26, 27 perpendicular line 30 blade cross-section 41 radial-direction flow 42 leak flow 43 blade tip vortex 110 casing

111 partition plate 112 fan chamber 113 mechanical chamber

114 compressor 115 ventilation hole 116 opening port 117 bell mouth 120 propeller fan 121 heat exchanger 122 motor 130 blow-out grille P1 first part P2 second part P3 third part R rotation axis

The invention claimed is:

1. A propeller fan, comprising:

a shaft part provided along a rotation axis; and a blade provided outside an outer circumference of the shaft part, the blade including a basal part connected to the shaft part, a first part positioned either at the basal part or closer to an outer circumference of the propeller fan than is the basal part and away from the rotation axis by a distance r1, a second part positioned away from the rotation axis by a distance r2 that is longer than r1, a third part positioned away from the rotation axis by a distance r3 that is longer than or equal to r2, and a tip part positioned at an outer circumferential end of the blade and away from the rotation axis by a distance rt that is longer than r3, a warping angle of the blade monotonically increases from the first part to the tip part, as a distance from the rotation axis increases, a relationship expressed as $(\theta 2-\theta 1)/(r2-r1)>(\theta t-\theta 3)/(rt-r3)\geq 0$ being satisfied, where θ1 denotes a warping angle of the blade in the first part, θ2 denotes a warping angle of the blade in the second part, θ3 denotes a warping angle of the blade in the third part, and θt denotes a warping angle of the blade in the tip part.

2. The propeller fan of claim 1, wherein a warping angle of the blade between the first part and the second part increases, as a distance from the rotation axis increases, and a warping angle of the blade between the third part and the tip part either increases or remains constant, as the distance from the rotation axis increases.

3. The propeller fan of claim 1, wherein a relationship expressed as $r2=r3$ is satisfied.

4. The propeller fan of claim 1, wherein a relationship expressed as $r3\leq 0.9\times rt$ is satisfied.

5. The propeller fan of claim 1, wherein, when a relationship between the distance from the rotation axis and the warping angle of the blade is expressed in a graph, at least a part of the graph that corresponds to a section between the first part and the second part is downwardly convex in a warping-angle axis.

6. The propeller fan of claim 1, wherein a warping angle of the blade between the third part and the tip part either linearly changes or remains constant, as a distance from the rotation axis increases.

7. An outdoor unit for an air-conditioning apparatus, the outdoor unit comprising the propeller fan of claim 1.

* * * * *